US006131004A

United States Patent [19]

Cho et al.

[11] Patent Number: 6,131,004

[45] Date of Patent: Oct. 10, 2000

[54] AIR CIRCULATION SYSTEM OF LIQUID ELECTROPHOTOGRAPHIC PRINTER

[75] Inventors: Min-su Cho, Incheon; Yun-geun Lee; Un-ho Baik, both of Suwon, all of Rep. of Korea

[73] Assignee: Samsung Electronics Co., Ltd., Kyungki-Do, Rep. of Korea

[21] Appl. No.: 09/390,997

[22] Filed: Sep. 7, 1999

[30] Foreign Application Priority Data

Sep. 4, 1998 [KR] Rep. of Korea ..... 98-36484
Nov. 13, 1998 [KR] Rep. of Korea ..... 98-48640

[51] Int. Cl.[7] ..... G03G 15/10; G03G 21/00

[52] U.S. Cl. ..... 399/92; 399/93; 399/249

[58] Field of Search ..... 399/92, 93, 343, 399/355, 237, 249, 250, 251

[56] References Cited

U.S. PATENT DOCUMENTS 5,819,137 10/1998 Hoffman et al. ..... 399/93
5,878,305 3/1999 Suzumura et al. ..... 399/97
5,905,928 5/1999 Shin ..... 399/250
5,946,528 8/1999 Cho ..... 399/93

FOREIGN PATENT DOCUMENTS 49-22144 2/1974 Japan .
5-204252 8/1993 Japan .
10-49010 2/1998 Japan .

*Primary Examiner*—Sophia S. Chen
*Attorney, Agent, or Firm*—Sughrue, Mion, Zinn, Macpeak & Seas, PLLC

[57] ABSTRACT

In an air circulation system of a liquid electrophotographic printer, an engine shell includes a developing unit for developing an electrostatic latent image which is formed on a photoreceptor belt and having an air injector, a drying unit for drying the developed image, and a transferring unit for transferring the developed image to print paper. Air in the engine shell is taken in and exhausted to the outside though a main path. A filter is installed on the main path for filtering air. A return path is branched from the main path and through which the air taken in from the engine shell is supplied to the air injector. An air pump provides a driving force such that air can flow along the main path and the return path. Thus, as air can be exhausted from the engine shell and the exhausted air can be re-supplied to the air injector using a single pump, the structure of the system is simplified.

8 Claims, 6 Drawing Sheets

AIR CIRCULATION SYSTEM OF LIQUID ELECTROPHOTOGRAPHIC PRINTER

BACKGROUND OF THE INVENTION

1. Field of the Invention

The present invention relates to an air circulation system of a liquid electrophotographic printer.

2. Description of the Related Art

A liquid electrophotographic printer such as a color laser printer, as shown in FIG. 1, includes a photoreceptor belt 10 circulating in one direction, a developing unit 20 having a developing roller 21 and a squeegee roller 23 for developing an electrostatic latent image formed on the photoreceptor belt 10, a drying unit 30 for drying the developed image, and a transferring unit 40 for printing the developed image on printer paper. These units are installed inside an engine shell 50 which is sealed to prevent intrusion of foreign material from the outside.

During a printing process, developer which is a mixture of toner and liquid carrier is provided to the photoreceptor belt 10 by means of the developing roller 21 in the developing unit 20. Subsequently, excess developer not used in the above developing process is removed by the squeegee roller 23. In doing so, an air injector 25 injects air so that the excess developer is prevented from flowing in a reverse direction, thus dropping downward.

Here, the air injected from the air injector 25 is supplied via a supply path 63 by a supply pump 61 installed outside the engine shell 50. The same amount of air supplied into the engine shell 50 by the air injector 25 should be exhausted from the engine shell 50 to the outside in order to maintain constant pressure in the engine shell 50. For this purpose, an exhaust pump 71 for exhausting the air from the engine shell 50 is installed. The air taken via an exhaust opening 51 of the engine shell 50 by a driving force of the exhaust pump 71 is exhausted through an exhaust path 73 and a filter 75.

However, in a liquid electrophotographic printer having the above structure, since a pump for injecting air and a pump for exhausting air are used, a large amount of space for the pumps is needed and accordingly a large amount of noise and vibration are generated.

SUMMARY OF THE INVENTION

To solve the above problems, it is an objective of the present invention to provide a liquid electrophotographic printer having an improved structure so that air can be circulated between the inside and outside of the engine shell using a single pump.

Accordingly, to achieve the above objective, there is provided an air circulation system of a liquid electrophotographic printer which comprises an engine shell in which a developing unit for developing an electrostatic latent image formed on a photoreceptor belt and having an air injector, a drying unit for drying the developed image, and a transferring unit for transferring the developed image to print paper, a main path through which air in the engine shell is taken in and exhausted to the outside, a filter installed on the main path for filtering air, a return path branched from the main path and through which the air taken in from the engine shell is supplied to the air injector, and an air pump providing a driving force such that air can flow along the main path and the return path.

It is preferred in the present invention that the air pump is installed at a branching point between the main path and the return path.

It is preferred in the present invention that the filter may be installed either downstream in the main path with respect to the air pump to filter only the air exhausted to the outside, or that the filter is installed upstream in the main path with respect to the air pump to filter the air exhausted from the engine shell and supplied to the air injector through the return path as well as the air exhausted to the outside.

It is preferred in the present invention that the system further comprises a noise damper installed downstream in the main path with respect to the air pump for reducing noise and vibration generated due to the air exhausted to the outside.

It is preferred in the present invention that the noise damper comprises a case having an inlet and an outlet, a plurality of guide plates alternately installed in the case to reduce the speed of air flowing in through the inlet by changing the flow direction, and a noise damping member having many pores, installed in the case.

It is preferred in the present invention that the system further comprises a sub-path through which air taken from the drying unit and passing a condenser is supplied to the main path.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
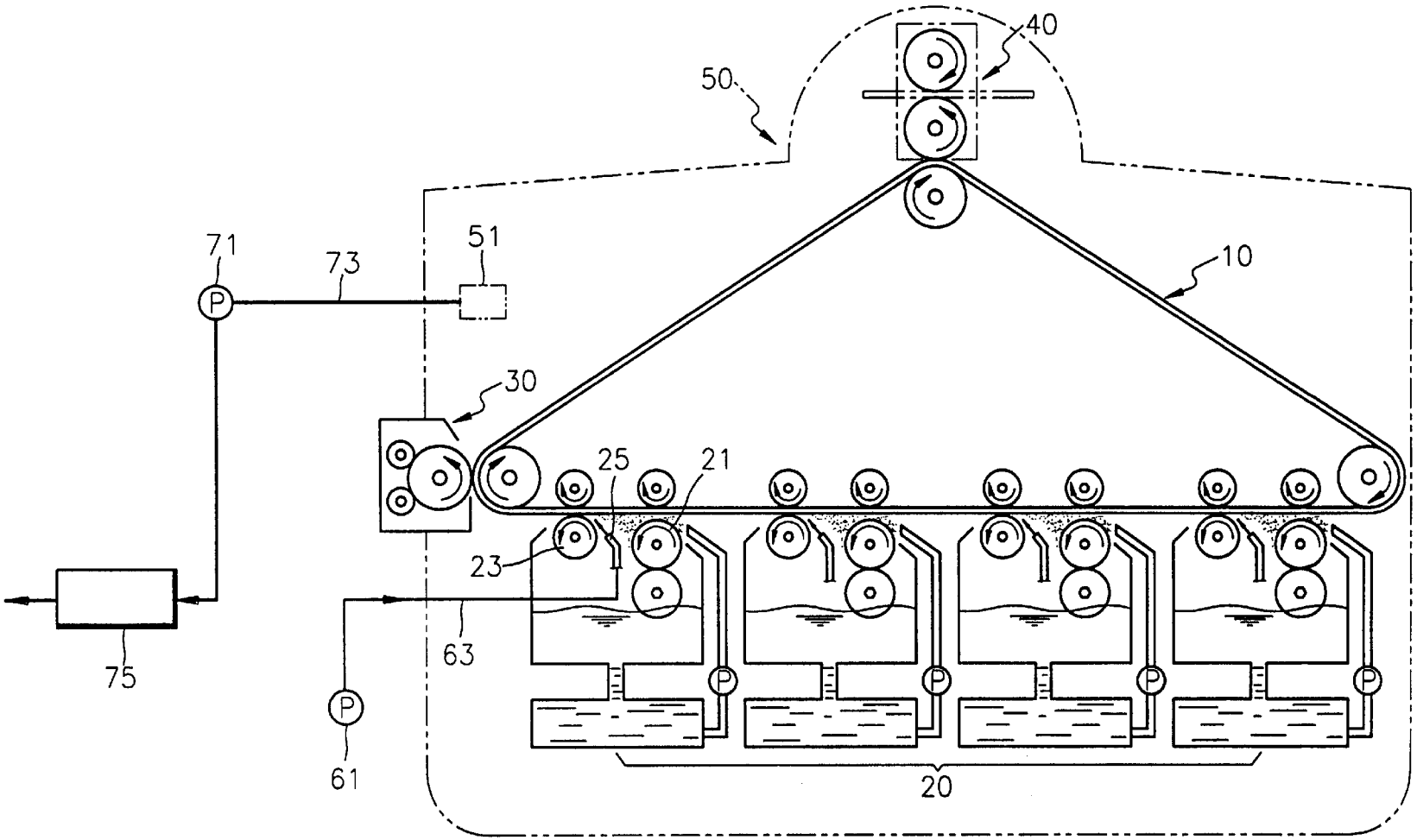
FIG. 1 (PRIOR ART)
FIG. 1 is a schematic view showing the structure of a general liquid electrophotographic printer.
Figure 2:
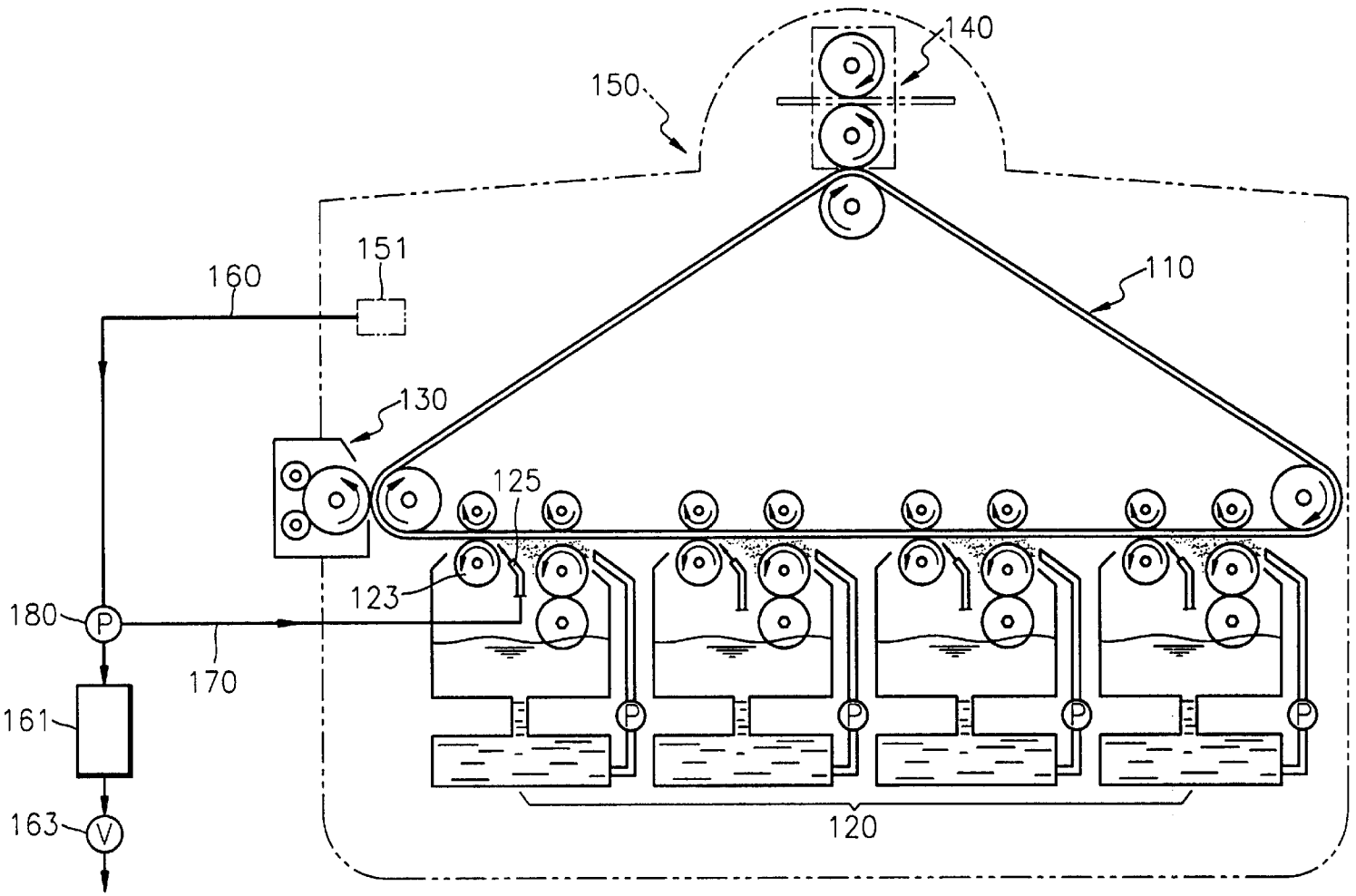
FIG. 2 is a schematic view showing the structure of an air circulation system of a liquid electrophotographic printer according to the first preferred embodiment of the present invention.

Referring to FIG. 2, an air circulation system of a liquid electrophotographic printer is comprised of a main path 160 through which air is exhausted from the engine shell 150 of the printer to the outside, a return path 170 branched from the main path 160 and through which air flowing along the main path 160 is re-supplied to the engine shell 150, and an air pump 180 installed at a connection point between the main path 160 and the return path 170.

In the engine shell 150, a developing unit 120 having an air injector 125 for injecting air between a photoreceptor belt 110 and a squeegee roller 123, a drying unit 130 for drying the photoreceptor belt 110, and a transferring unit 140 for transferring an image developed on the photoreceptor belt to print paper are installed.

On the main path 160, there are a filter 161 for filtering and exhausting air taken through an exhaust opening 151 of the engine shell 150, and a valve 163 for regulating the amount of exhausted air. The return path 170 branches out from the main path 160 and is connected to the air injector 125.

In the operation of the printer, when the air pump 180 is operated, the air in the engine shell 150 is taken into the main path 160 through the exhaust opening 151. Part of the air taken in is supplied to the air injector 125 along the return path 170 to be used in removing excess developer. The rest of the air is filtered by the filter 161 and exhausted to the outside.

FIG. 3 through FIG. 6 show additional preferred embodiments of the present invention. The same reference numerals in these drawings indicate the same elements having the same functions.

Figure 3:
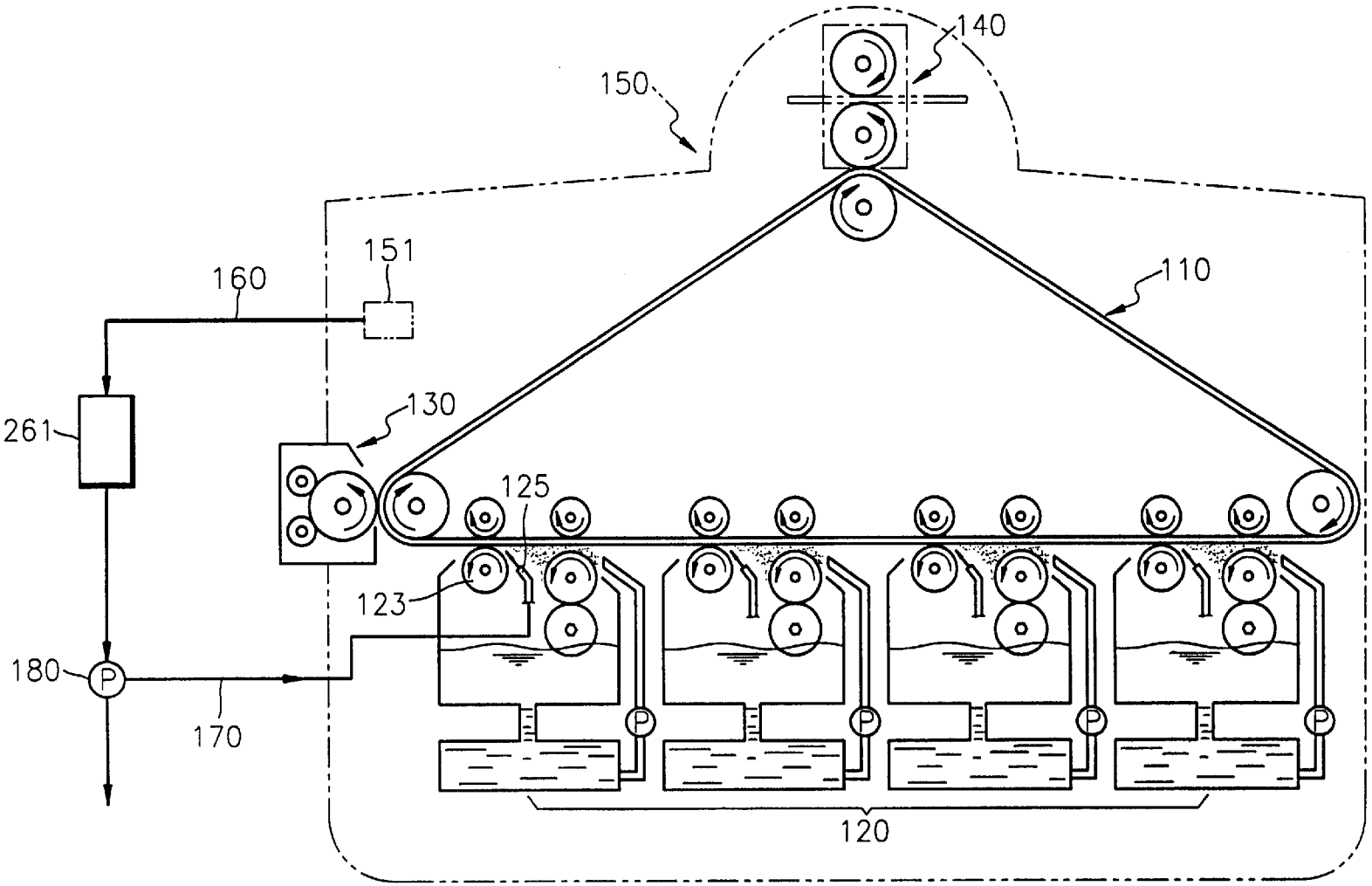
FIG. 3 is a schematic view showing the structure of an air circulation system of a liquid electrophotographic printer according to the second preferred embodiment of the present invention.

In the second preferred embodiment shown in FIG. 3, a filter 261 is installed upstream in a main path 160 with respect to the air pump 180. Thus, all of the air taken in from the engine shell 150 via the main path 160 is filtered and part of the air is supplied to an air injector 125 along a return path 170 and the rest of air is exhausted to the outside.

Figure 4:
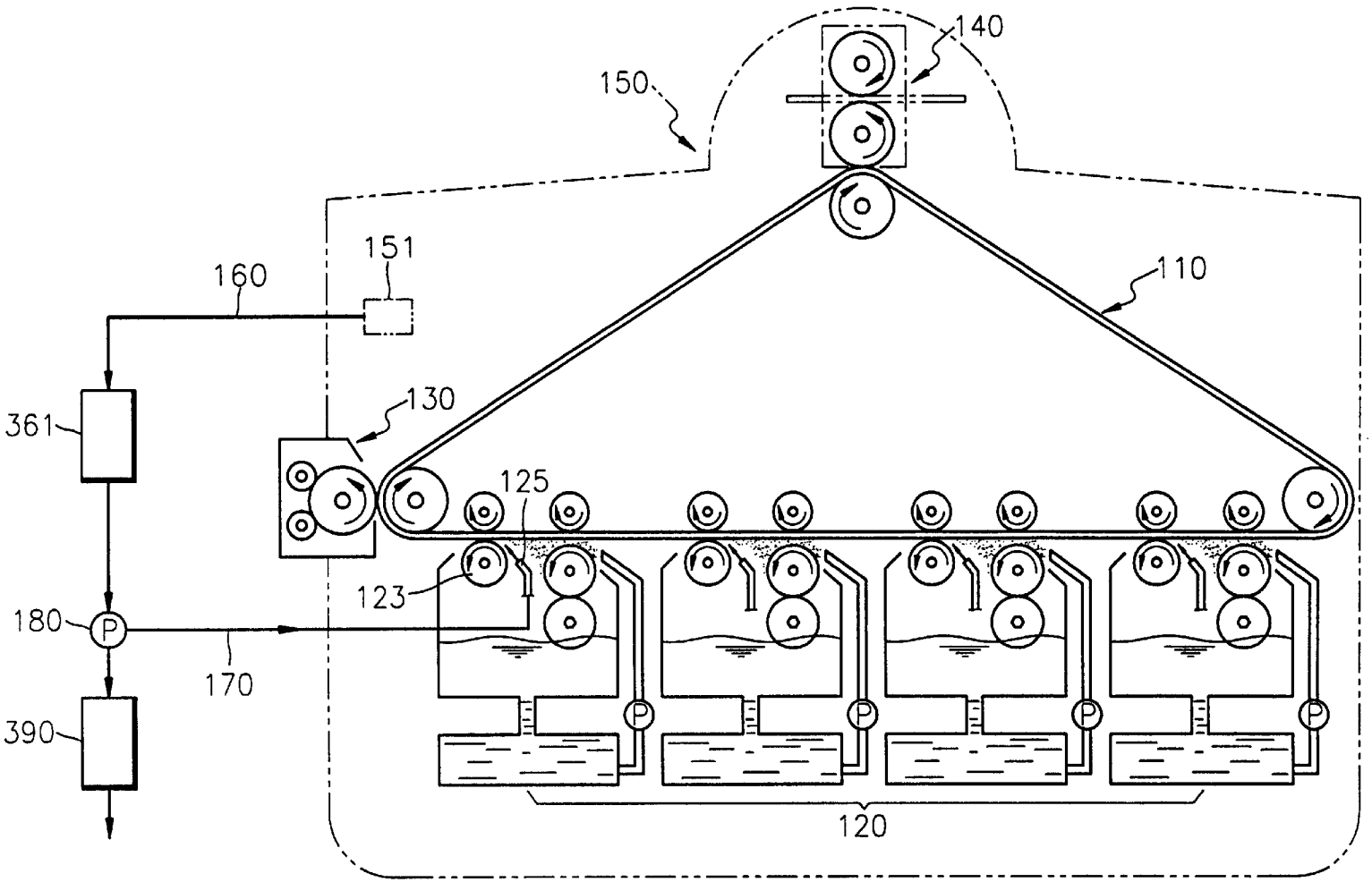
FIG. 4 is a schematic view showing the structure of an air circulation system of a liquid electrophotographic printer according to the third preferred embodiment of the present invention.

FIG. 4 shows an air circulation system according to the third preferred embodiment of the present invention. Referring to the drawing, a filter 361 is installed upstream in the main path 160 with respect to the air pump 180 and a noise damper 390 is installed downstream of the air pump 180.

Figure 5:
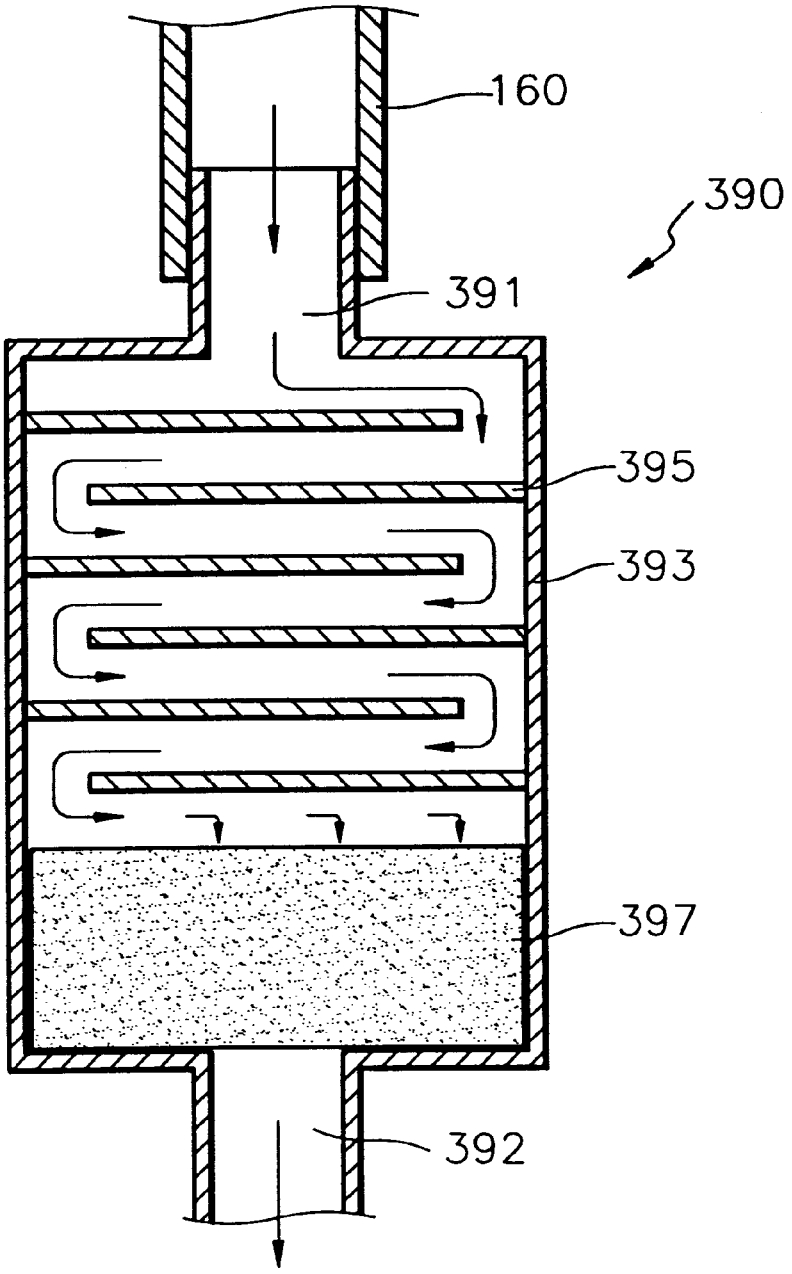
FIG. 5 is a sectional view of the noise damper shown in FIG. 4.

The noise damper 390 reduces noise and vibration generated due to the air flowing through the main path 160. The noise damper 390, as shown in FIG. 5, is comprised of a case 393 having an inlet 391 and an outlet 392, a plurality of guide plates 395, and a noise damping member 397 installed in the case 393.

The guide plate 395 reduces the flow rate of the air by changing the flow direction of the air taken in the inlet 391. Preferably, the guide plates 395 are alternately installed in the case 393 such that the air flows back and forth through the noise damper 390.

The noise damping member 397 is installed downstream of the guide plates 395. The noise damping member 397 has many pores so that noise and vibration are absorbed while air passes by.

In the operation of the air circulation system according to the preferred embodiment, when the air pump 180 is operated, air is circulated through the main path 160 and the return path 170. Also, noise and vibration are absorbed while the air exhausted to the outside passes through the noise damper 390.

Figure 6:
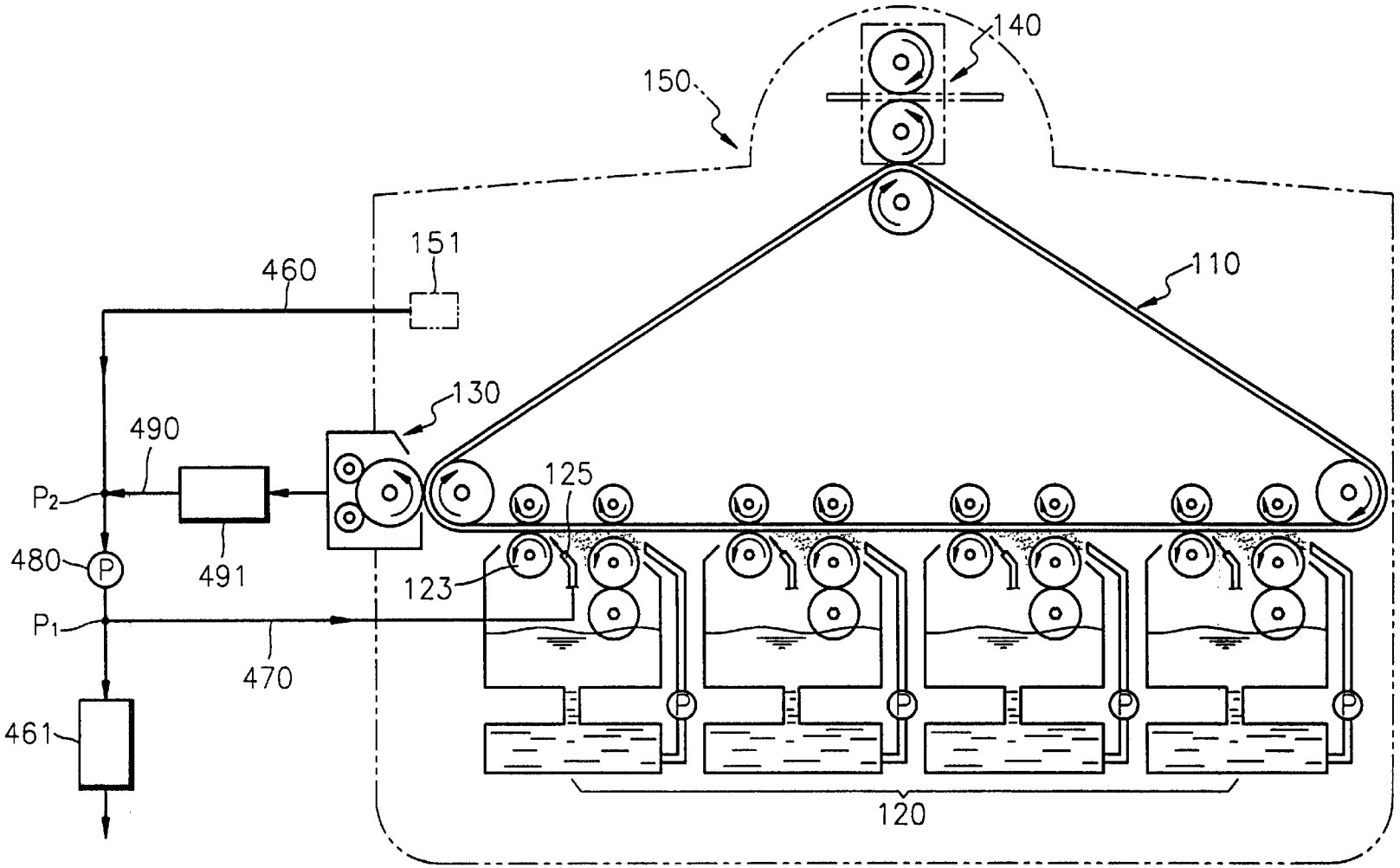
FIG. 6 is a schematic view showing the structure of an air circulation system of a liquid electrophotographic printer according to the fourth preferred embodiment of the present invention.

FIG. 6 shows an air circulation system of a liquid electrophotographic printer according to the fourth preferred embodiment of the present invention. A filter 461 for filtering only the air exhausted to the outside is installed downstream with respect to a point P1 where a return path 470 is branched from a main path 460. Also, a sub-path 490 is connected to the main path 460 at a point P2 and the air from the drying unit 130 which passes through a condenser 491 is supplied to the main path 460. An air pump 480 is installed between the point P1 and the point P2 on the main path 460.

When the air pump 480 is operated, air is taken in from the engine shell 150 and the drying unit 130 along the main path 460 and the sub path 490. Part of the air taken in is supplied to the air injector 125 along the return path 470 and the rest of the air is filtered by the filter 461 and exhausted to the outside.

As described above, according to the air circulation system of a liquid electrophotographic printer, since air can be exhausted from the engine shell and the exhausted air can be re-supplied to the air injector using a single pump, the structure of the system is simplified. Also, by further providing a noise damper on the main path, noise and vibration generated due to the exhausted air can be effectively reduced.

What is claimed is:

1. An air circulation system of a liquid electrophotographic printer, comprising:

an engine shell in which are installed:

a developing unit for developing an electrostatic latent image formed on a photoreceptor belt and having at least one air injector;

a drying unit for drying the developed image; and a transferring unit for transferring the developed image to a print paper;

a main path through which air from said engine shell is taken in and exhausted to outside said engine shell;

a filter installed in said main path for filtering air;

a return path branched from said main path and through which at least some of the air taken in from said engine shell is supplied to said at least one air injector; and an air pump providing a driving force to cause air to flow along said main path and said return path, wherein said air pump is installed at a branching point between said main path and said return path.

2. The system of claim 1, wherein said filter is installed in said main path downstream of said air pump to filter only the air exhausted to outside said engine shell.

3. The system of claim 1, wherein said filter is installed in said main path upstream of said air pump.

4. The system as claimed in claim 3, wherein said filter filters the air exhausted from said engine shell and supplied to said air injector through said return path, as well as the air exhausted to outside said engine shell.

5. The system of claim 1, further comprising a noise damper installed in said main path downstream of said air pump, for reducing noise and vibration generated due to the air exhausted to outside said engine shell.

6. The system of claim 5, wherein said noise damper comprises:

a case having:

an inlet and an outlet;

a plurality of guide plates alternately installed in said case to reduce the speed of air flowing from said inlet to said outlet by changing the flow direction; and a noise damping member having many pores installed in said case.

7. The system as claimed in claim 6, wherein said case of said noise damper has six surfaces including an inlet surface, an outlet surface, a top surface, a bottom surface, and two side surfaces; and said plurality of guide plates are disposed in said case, perpendicularly intersecting said top surface and said bottom surface, alternately perpendicularly intersecting one of said side surfaces, and having space provided therebetween.

8. The system of claim 1, further comprising a sub-path through which air is taken in from said drying unit, passes through a condenser, and is supplied to said main path.

* * * * *